US009776400B2

(12) United States Patent
Ge et al.

(10) Patent No.: US 9,776,400 B2
(45) Date of Patent: Oct. 3, 2017

(54) PRINTHEAD WITH A NUMBER OF MEMRISTOR CELLS AND A PARALLEL CURRENT DISTRIBUTOR

(71) Applicant: HEWLETT-PACKARD DEVELOPMENT COMPANY, L.P., Houston, TX (US)

(72) Inventors: Ning Ge, Palo Alto, CA (US); Jianhua Yang, Palo Alto, CA (US); Zhiyong Li, Foster City, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/326,089

(22) PCT Filed: Jul. 26, 2014

(86) PCT No.: PCT/US2014/048324

§ 371 (c)(1),
(2) Date: Jan. 13, 2017

(87) PCT Pub. No.: WO2016/018199

PCT Pub. Date: Feb. 4, 2016

(65) Prior Publication Data

US 2017/0203561 A1 Jul. 20, 2017

(51) Int. Cl.
*B41J 2/045* (2006.01)

(52) U.S. Cl.
CPC ..... *B41J 2/04541* (2013.01); *B41J 2/0455* (2013.01); *B41J 2/0458* (2013.01); *B41J 2/04581* (2013.01); *B41J 2202/13* (2013.01)

(58) Field of Classification Search
CPC .. B41J 2/04541; B41J 2/0458; B41J 2/04581; B41J 2/04501; B41J 2/04548; B41J 2/0455; B41J 2202/13; G11C 13/00; G11C 13/0002; G11C 13/004; G11C 2013/0045
See application file for complete search history.

(56) References Cited

U.S. PATENT DOCUMENTS 6,808,241 B2 10/2004 MacKenzie et al.
8,421,051 B2 4/2013 Sato et al.
8,882,217 B2 * 11/2014 Lea ..... B41J 2/1753 347/58

(Continued)

OTHER PUBLICATIONS

Vourkas, I. et al., Improved Read Voltage Margins with Alternative Topologies for Memristor-based Crossbar Memories, IEEE, Jul. 2, 2013, pp. 364-367.

*Primary Examiner* — Geoffrey Mruk
(74) *Attorney, Agent, or Firm* — Fabian Van Cott

(57) ABSTRACT

A printhead with a number of memristors and a parallel current distributor is described. The printhead includes a number of nozzles to deposit an amount of fluid onto a print medium. Each nozzle includes a firing chamber to hold the amount of fluid, an opening to dispense the amount of fluid onto the print medium, and an ejector to eject the amount of fluid through the opening. The printhead also includes a number of memristor cells. Each memristor cell includes a memristor to store information and a multiplexing component to select a memristor. The printhead also includes and at least one current distributor connected in parallel to a number of memristor cells.

15 Claims, 7 Drawing Sheets

(56) References Cited

U.S. PATENT DOCUMENTS

| | | | |
|---|---|---|---|
| 2009/0244132 | A1 | 10/2009 | Bruce et al. |
| 2009/0284558 | A1 | 11/2009 | Cerutti |
| 2010/0085795 | A1 | 4/2010 | Zhu et al. |
| 2010/0202185 | A1 | 8/2010 | Katoh et al. |
| 2011/0103131 | A1 | 5/2011 | Katayama et al. |
| 2011/0310181 | A1 | 12/2011 | Curcio et al. |
| 2013/0106930 | A1 | 5/2013 | Lea et al. |

* cited by examiner

PRINTHEAD WITH A NUMBER OF MEMRISTOR CELLS AND A PARALLEL CURRENT DISTRIBUTOR

BACKGROUND

A memory system may be used to store data. In some examples, imaging devices, such as printheads may include memory to store information relating to printer cartridge identification, security information, and authentication information, among other types of information.

BRIEF DESCRIPTION OF THE DRAWINGS

The accompanying drawings illustrate various examples of the principles described herein and are a part of the specification. The illustrated examples do not limit the scope of the claims.

Throughout the drawings, identical reference numbers designate similar, but not necessarily identical, elements.

DETAILED DESCRIPTION

Figure 1:
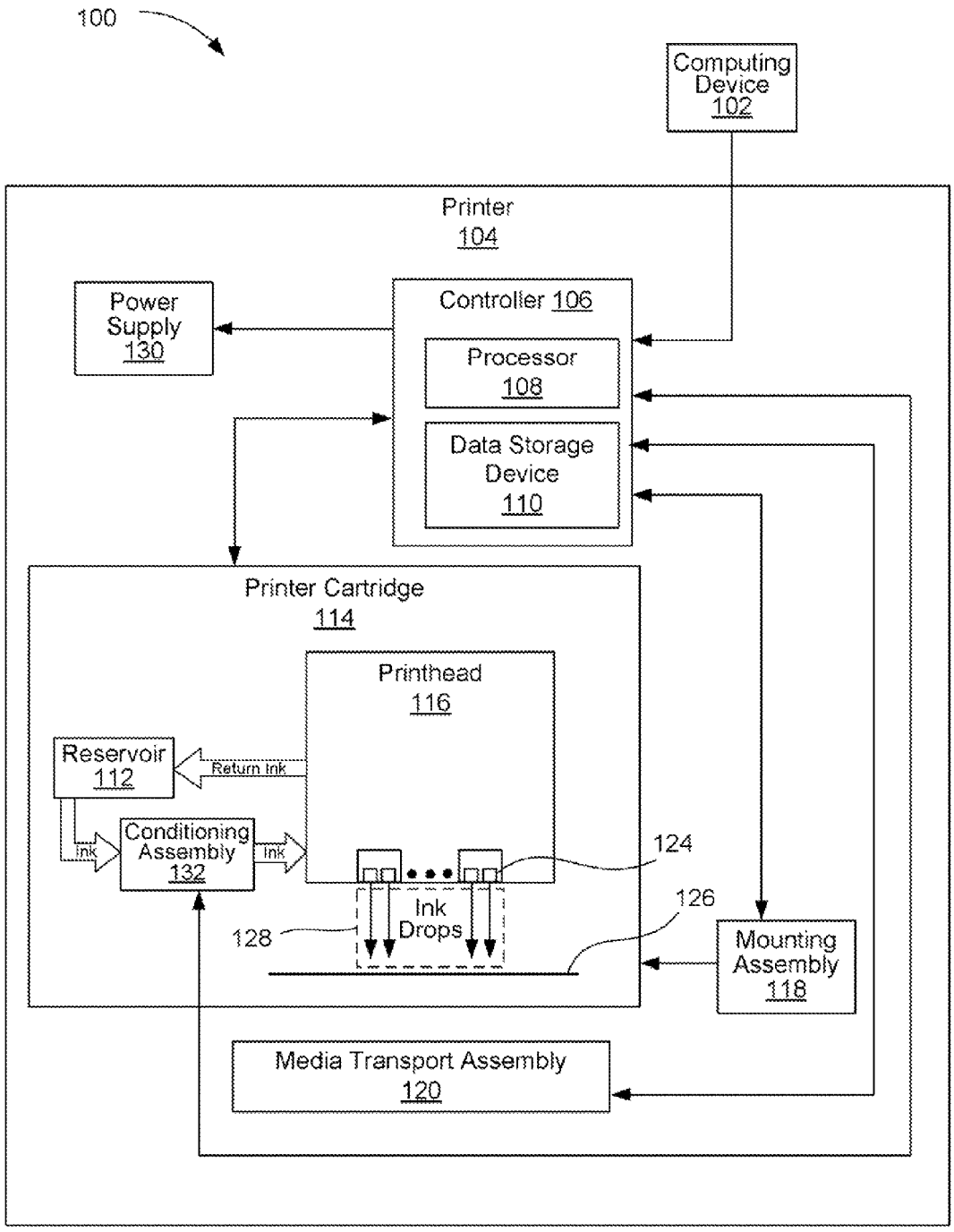
FIG. 1 is a diagram of a printing system according to one example of the principles described herein.

Memory devices are used to store information for a printer cartridge Printer cartridges include memory to store information related to the operation of the printhead. For example, a printhead may include memory to store information related 1) to the printhead; 2) to fluid, such as ink, used by the printhead; or 3) to the use and maintenance of the printhead. Other examples of information that may be stored on a printhead include information relating to 1) a fluid supply, 2) fluid identification information, 3) fluid characterization information, and 4) fluid usage data, among other types of fluid or imaging device related data. More examples of information that may be stored include identification information, serial numbers, security information, feature information, Anti-Counterfeiting (ACF) information, among other types of information. While memory usage on printheads is desirable, changing circumstances may reduce their efficacy in storing information.

For example, an increasing trend in counterfeiting may lead to current memory devices being too small to contain sufficient anti-counterfeiting information and security and authentication information. Additionally, with loyalty customer reward programs, new business models and other customer relation management programs through cloud-printing and other printing architectures, additional market data, customer appreciation value information, encryption information, and other types of information on the rise, a manufacturer may desire to store more information on a memory device.

Moreover, as new technologies develop, circuit space is at a premium. Accordingly, it may be desirable for the greater amounts of data storage to occupy less space within a device Memristors may be used due to their non-volatility, low operational power consumption characteristics, and their compact size. A memristor selectively stores data based on a resistance state of the memristor. For example, a memristor may be in a low resistance state indicated by a "1," or a high resistance state indicated by a "0." Memristors may form a string of ones and zeroes that will store the aforementioned data if an analog memristor is used, there may be many different resistance states.

A memristor may switch between a low resistance state and a high resistance state during a switching event in which a voltage is passed to the memristor. Each memristor has a switching voltage that refers to a voltage used to switch the state of the memristors. When the supplied voltage is greater than the memristor switching voltage, the memristor switches state. The switching voltage is largely based on the size of the memristor. For example, a larger memristor may use a larger voltage to execute a switching event. While memristors may be beneficial as memory storage devices, their use presents a number of complications.

For example, a memristor may inadvertently switch states during a reading operation, which inadvertent switching may lead to incorrect data retrieval or a failure to retrieve data. More specifically, to read data from a memristor, a read circuit applies a current to the memristor. A voltage is then measured across the memristor. Using Ohm's law, the supplied current, and the measured voltage, a resistance of the memristor may be obtained and a logical value (i.e., a 1 or a 0) is associated with that memristor. In this fashion a number of memristors may be processed to form a string of ones and zeroes to read information from a memristor array.

However, due to the value of the current provided during a read operation, the voltage across the memristor may be greater than a switching voltage of the memristor. The measured voltage across the memristor being greater than the switching voltage may cause the memristor to switch states during a read operation.

A specific example is given as follows. In this example, a resistance of 6,000 Ohms (Ω) may be associated with a high resistance value, a resistance of 1,000Ω may be associated with a low resistance state, and a memristor may have a switching voltage of 5 volts (V), in this example, a read current of approximately 1.2 milliamperes (mA) may be passed through the memristor. In this example, a voltage measurement device may indicate a voltage of 7.2 V across the memristor. Using Ohms law, (V=R*I where R refers to resistance, V refers to voltage, and I refers to current), the resistance of the memristor may be determined to be 6,000Ω and a logical value of 1 associated with the memristor.

However, in this example, as the 7.2 V is greater than the switching voltage, in this example 5 V, an unintended switch of the memristor resistance state may occur, which may lead to incorrect data retrieval or a failure to retrieve data. It should be noted that the specific values indicated are for illustration purposes and any value resistance, voltage, and current values may be used in accordance with the present specification Moreover, the voltage passing through the system may be outside a safe operating range. For example, in some cases the voltage measured across the memristor in response to a reading current may be greater than an upper threshold voltage value for a controller such as an application-specific integrated circuit (ASIC), for example 16 V in some cases. As the measured voltage exceeds the threshold voltage, the ASIC may also be damaged.

According, the present specification describes a printhead and printer cartridge having memristor cells and a parallel current distributor. In this example, the current distributor may be a circuit element placed between the read circuit and a memristor cells such that the current passed to the memristor cell to read the value of the memristor is reduced such that the voltage across the memristor does not surpass the switching voltage of the memristor. For example, a current distributor may be a resistor with a value of 6,000Ω. Continuing the example from above, this current distributor reduces the current passing through the memristor from 1.2 mA to 0.6 mA. This reduction in current and the "off" resistance of 6,000Ω of the memristor would result in a measured voltage across the memristor of approximately 3.6 V using Ohm's Law. As the 3.6 V is smaller than the switching voltage of the memristor, 5 V, no switching event would occur and more accurate data storage and data retrieval would result.

More specifically, the present disclosure describes a printhead with a number of memristor cells and a parallel current distributor. The printhead includes a number of nozzles to deposit an amount of fluid onto a print medium. Each nozzle includes a firing chamber to hold the amount of fluid, an opening to dispense the amount of fluid onto a print medium, and an ejector to eject the amount of fluid through the opening. The printhead also includes a number of memristor cells. Each memristor cell includes a memristor to store information and a multiplexing component to select a memristor. The printhead also includes at least one current distributor connected in parallel to a number of memristor cells.

The present disclosure describes a printer cartridge with a number of memristor cells and a parallel current distributor. The cartridge includes a fluid supply and a printhead to deposit fluid from the fluid supply onto a print medium. The printhead includes at least one memristor, at least one multiplexing component coupled to the memristor, and at least one current distributor connected in parallel to the memristor to reduce current flow through the memristor.

A printer cartridge and a printhead that utilize memristor cells and a parallel current distributor may be beneficial by reducing the voltage across a memristor during a read operation so as to avoid an inadvertent switching during a read operation. Additionally, the printer cartridge and the printhead of the present specification reduce the overall control line resistance such that a controller of the system operates within a safe operating range. Doing so may avoid damage to the controller.

As used in the present specification and in the appended claims, the term "printer cartridge" may refer to a device used in the ejection of ink, or other fluid, onto a print medium. In general, a printer cartridge may be a fluidic ejection device that dispenses fluid such as ink, wax, polymers or other fluids. A printer cartridge may include a printhead. In some examples, a printhead may be used in printers, graphic plotters, copiers and facsimile machines. In these examples, a printhead may eject ink, or another fluid, onto a medium such as paper to form a desired image or a desired three-dimensional geometry.

Accordingly, as used in the present specification and in the appended claims, the term "printer" is meant to be understood broadly as any device capable of selectively placing a fluid onto a print medium. In one example the printer is an inkjet printer. In another example, the printer is a three-dimensional printer. In yet another example, the printer is a digital titration device.

Still further, as used in the present specification and in the appended claims, the term "fluid" is meant to be understood broadly as any substance that continually deforms under an applied shear stress. In one example, a fluid may be a pharmaceutical. In another example, the fluid may be an ink. In another example, the fluid may be a liquid.

Still further, as used in the present specification and in the appended claims, the term "print medium" is meant to be understood broadly as any surface onto which a fluid ejected from a nozzle of a printer cartridge may be deposited. In one example, the print medium may be paper. In another example, the print medium may be en edible substrate. In yet one more example, the print medium may be a medicinal pill.

Yet further, as used in the present specification and in the appended claims, the term "read circuit" is meant to be understood broadly as any number of circuitry components used to determine the resistance state of a memristor and to associate a particular logical value with the resistance state. Examples of components included in the read circuit may include a current source that applies a fixed reading current to the memristor and a voltage measurement device that measures the voltage across the memristor, in particular the voltage responsive to the fixed reading current.

Even yet further, as used in the present specification and in the appended claims, the term "memristor" may refer to a passive two-terminal circuit element that maintains a functional relationship between the time integral of current, and the time integral of voltage.

Yet further, as used in the present specification and in the appended claims, the term "program ratio" may refer to ratio of the resistance of a memristor in a high resistance state compared to the resistance of the memristor in a low resistance state. For example, a program ratio of 3.5 may indicate that the memristor has a resistance in a high resistance state that is 3.5 times greater than the resistance of the memristor while in a low resistance state.

Yet further, as used in the present specification and in the appended claims, the term "a number of" or similar language may include any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Turning now to the figures, FIG. 1 is a diagram of a printing system (100) according to one example of the principles described herein. The printing system (100) includes a printer (104). The printer (104) includes an interface with a computing device (102). The interface enables the printer (104), and specifically the processor (108), to interface with various hardware elements, such as the computing device (102), external and internal to the printer (104). Other examples of external devices include external storage devices, network devices such as servers, switches, routers, and client devices among other types of external devices.

In general, the computing device (102) may be any source from which the printer (104) may receive data describing a print job to be executed by the controller (106) of the printer (104) in order to print an image onto the print medium (126). For example, via the interface, the controller (106) receives data from the computing device (102) and temporarily stores the data in the data storage device (110). Data may be sent to the printer (104) along an electronic, infrared, optical, or other information transfer path. The data may represent a document and/or file to be printed. As such, data forms a print job for the printer (104) and includes one or more print job commands and/or command parameters.

A controller (106) of the printer (104) includes a processor (108), a data storage device (110), firmware, software, and other electronics for communicating with and controlling the printhead (116), mounting assembly (118), and media transport assembly (120). The controller (106) receives data from the computing device (102) and temporarily stores data in the data storage device (110).

The controller (106) controls the printhead (116) in ejecting fluid from the nozzles (124). For example, the controller (106) defines a pattern of ejected fluid drops that form characters, symbols, and/or other graphics or images on the print medium (126). The pattern of ejected fluid drops is determined by the print job commands and/or command parameters received from the computing device (102). The controller (106) may be an application specific integrated circuit (ASIC) on a printer (104) which determines the level of fluid in the printhead (116) based on resistance values of memristors integrated on the printhead (116). The printer ASIC may include a current source and an analog to digital converter (ADC). The ASIC converts a voltage present at the current source to determine a resistance of a memristor, and then determine a corresponding digital resistance value through the ADC. Computer readable program code, executed through executable instructions enables the resistance determination and the subsequent digital conversion through the ADC.

The processor (108) may include the hardware architecture to retrieve executable code from the data storage device (110) and execute the executable code. The executable code may, when executed by the processor (108), cause the processor (108) to implement at least the functionality of printing on the print medium (126), and actuating the mounting assembly (118) and the media transport assembly (120) according to the present specification. The executable code may, when executed by the processor (108), cause the processor (108) to implement the functionality of providing instructions to the power supply (130) such that the power supply (130) provides power to the components of the printer (104).

The data storage device (110) may store data such as executable program code that is executed by the processor (108) or other processing device. The data storage device (110) may specifically store computer code representing a number of applications that the processor (108) executes to implement at least the functionality described herein.

Generally, the data storage device (110) may include a computer readable medium, a computer readable storage medium, or a non-transitory computer readable medium, among others. For example, the data storage device (110) may be, but not limited to, an electronic magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The printing system (100) includes a printer cartridge (114) that includes a printhead (116), a reservoir (112), and a conditioning assembly (132). The printer cartridge (114) may be removable from the printer (104) for example, as a replaceable printer cartridge (114).

The printer cartridge (114) includes a printhead (116) that ejects drops of fluid through a plurality of nozzles (124) towards a print medium (126). The print medium (126) may be any type of suitable sheet or roll material, such as paper, card stock, transparencies, polyester, plywood, foam board, fabric, canvas, and the like. In another example, the print medium (126) may be en edible substrate. In yet one more example, the print medium (126) may be a medicinal pill.

Nozzles (124) may be arranged in one or more columns or arrays such that properly sequenced ejection of fluid from the nozzles (124) causes characters, symbols and/or other graphics or images to be printed on the print medium (126) as the printhead (116) and print medium (126) are moved relative to each other. In one example, the number of nozzles (124) fired may be a number less than the total number of nozzles (124) available and defined on the printhead (116).

The printer cartridge (114) also includes a fluid reservoir (112) to supply an amount of fluid to the printhead (116). In general, fluid flows from the reservoir (112) to the printhead (116), and the reservoir (112) and the printhead (116) form a one-way fluid delivery system or a recirculating fluid delivery system. In a one-way fluid delivery system, fluid supplied to the printhead (116) is consumed during printing. In a recirculating fluid delivery system, however, a portion of the fluid supplied to printhead (116) is consumed during printing. Fluid not consumed during printing is returned to the reservoir (112).

The reservoir (112) may supply fluid under positive pressure through a conditioning assembly (132) to the printhead (116) via an interface connection, such as a supply tube. The reservoir (112) may include pumps and pressure regulators. Conditioning in the conditioning assembly (132) may include filtering, pre-heating, pressure surge absorption, and degassing. Fluid is drawn under negative pressure from the printhead (116) to the reservoir (112). The pressure difference between the inlet and outlet to the printhead (116) is selected to achieve the correct backpressure at the nozzles (124).

A mounting assembly (118) positions the printhead (116) relative to media transport assembly (120), and media transport assembly (120) positioning the print medium (126) relative to printhead (116). Thus, a print zone (128), indicated by the dashed box, is defined adjacent to the nozzles (124) in an area between the printhead (116) and the print medium (126). In one example, the printhead (116) is a scanning type printhead (116). As such, the mounting assembly (118) includes a carriage for moving the printhead (116) relative to the media transport assembly (120) to scan the print medium (126). In another example, the printhead (116) is a non-scanning type printhead (116). As such, the mounting assembly (118) fixes the printhead (116) at a prescribed position relative to the media transport assembly (120). Thus, the media transport assembly (120) positions the print medium (126) relative to the printhead (116).

Figure 2A:
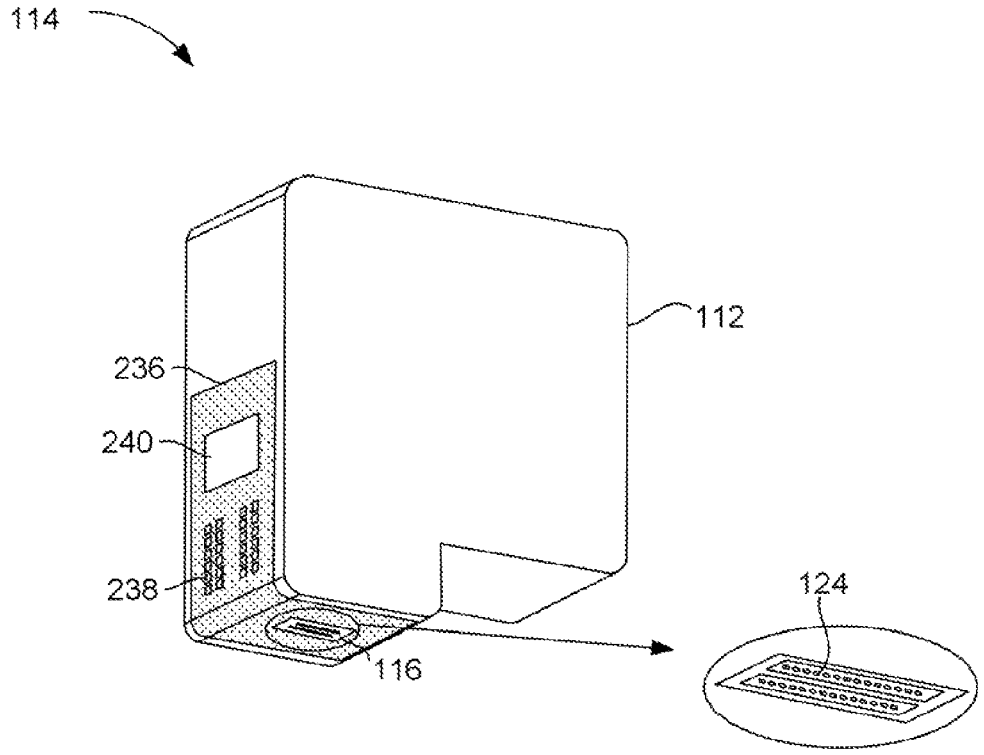
FIG. 2A is a diagram of a printer cartridge with a number of memristors and a parallel current distributor according to one example of the principles described herein.
Figure 2B:
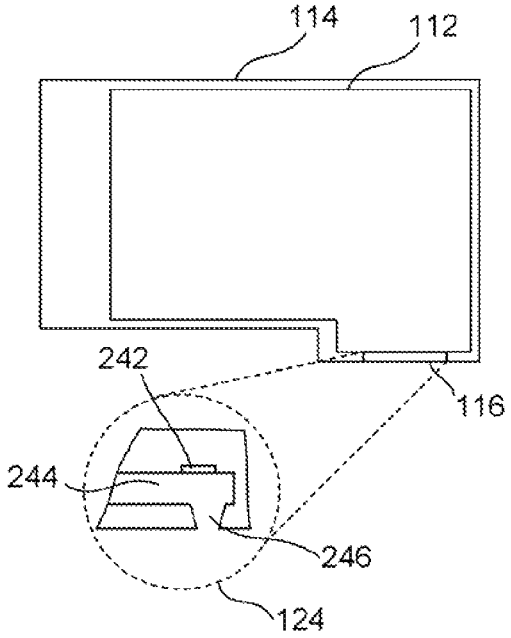
FIG. 2B is a cross sectional diagram of a printer cartridge with a number of memristors and a parallel current distributor according to one example of the principles described herein.

FIG. 2A is a diagram of a printer cartridge (114) and printhead (116) with a number of memristors having parallel current distributors according to one example of the principles described herein. As discussed above, the printhead (116) may comprise a number of nozzles (124). In some examples, the printhead (116) may be broken up into a number of print dies with each die having a number of nozzles (124). The printhead (116) may be any type of printhead (116) including, for example, a printhead (116) as described in FIGS. 2A and 2B The examples shown in FIGS. 2A and 2B are not meant to limit the present description. Instead, various types of printheads (116) may be used in conjunction with the principles described herein.

The printer cartridge (114) also includes a fluid reservoir (112), a flexible cable (236), conductive pads (238), and a memristor array (240). The flexible cable (236) is adhered to two sides of the printer cartridge (114) and contains traces that electrically connect the memristor array (240) and printhead (116) with the conductive pads (238).

The printer cartridge (114) ray be installed into a cradle that is integral to the carriage of a printer (FIG. 1, 104). When the printer cartridge (114) is correctly installed, the conductive pads (238) are pressed against corresponding electrical contacts in the cradle, allowing the printer (FIG. 1, 104) to communicate with, and control the electrical functions of, the printer cartridge (114). For example, the conductive pads (238) allow the printer (FIG. 1, 104) to access and write to the memristor array (240).

The memristor array (240) may contain a variety of information including the type of printer cartridge (114), the kind of fluid contained in the printer cartridge (114), an estimate of the amount of fluid remaining in the fluid reservoir (112), calibration data, error information, and other data. In one example, the memristor array (240) may include information regarding when the printer cartridge (114) should be maintained. The memristor array (240) may include other information as described below in connection with FIG. 3.

To create an image, the printer (FIG. 1, 104) moves the carriage containing the printer cartridge (114) over a print medium (FIG. 1, 126). At appropriate times, the printer (FIG. 1, 104) sends electrical signals to the printer cartridge (114) via the electrical contacts in the cradle. The electrical signals pass through the conductive pads (238) and are routed through the flexible cable (236) to the printhead (116). The printhead (116) then ejects a small droplet of fluid from the reservoir (112) onto the surface of the print medium (FIG. 1, 126). These droplets combine to form an image on the surface of the print medium (FIG. 1, 126).

The printhead (116) may include any number of nozzles (124). In an example where the fluid is an ink, a first subset of nozzles (124) may eject a first color of ink while a second subset of nozzles (124) may eject a second color of ink. Additional groups of nozzles (124) may be reserved for additional colors of ink.

FIG. 2B is a cross sectional diagram of a printer cartridge (114) and printhead (116) with a number of memristors disposed on enclosed gate transistors according to one example of the principles described herein. The printer cartridge (114) may include a fluid supply (112) that supplies the fluid to the printhead (116) for deposition onto a print medium. In some examples, the fluid may be ink. For example, the printer cartridge (114) may be an inkjet printer cartridge, the printhead (116) may be an inkjet printhead, and the ink may be inkjet ink.

The printer cartridge (114) may include a printhead (116) to carry out at least a part of the functionality of depositing fluid onto a print medium (FIG. 1, 126). The printhead (116) may include a number of components for depositing a fluid onto a print medium (FIG. 1, 126). For example, the printhead (116) may include a number of nozzles (124). For simplicity, FIG. 2B indicates a single nozzle (124), however a number of nozzles (124) are present on the printhead (116). A nozzle (124) may include an ejector (242), a firing chamber (244), and an opening (246). The opening (246) may allow fluid, such as ink, to be deposited onto a surface, such as a print medium (FIG. 1, 126). The firing chamber (244) may include a small amount of fluid. The ejector (242) may be a mechanism for ejecting fluid through an opening (246) from a firing chamber (244), where the ejector (242) may include a firing resistor or other thermal device, a piezoelectric element, or other mechanism for ejecting fluid from the firing chamber (244).

For example, the ejector (242) may be a firing resistor. The firing resistor heats up in response to an applied voltage. As the firing resistor heats up, a portion of the fluid in the firing chamber (244) vaporizes to form a bubble. This bubble pushes liquid fluid out the opening (246) and onto the print medium (FIG. 1, 126). As the vaporized fluid bubble pops, a vacuum pressure within the firing chamber (244) draws fluid into the firing chamber (244) from the fluid supply (112), and the process repeats. In this example, the printhead (116) may be a thermal inkjet printhead.

In another example, the ejector (242) may be a piezoelectric device. As a voltage is applied, the piezoelectric device changes shape which generates a pressure pulse in the firing chamber (244) that pushes a fluid out the opening (246) and onto the print medium (FIG. 1, 126). In this example, the printhead (116) may be a piezoelectric inkjet printhead.

The printhead (116) and printer cartridge (114) may also include other components to carry out various functions related to printing. For simplicity, in FIGS. 2A and 2B, a number of these components and circuitry included in the printhead (116) and printer cartridge (114) are not indicated; however such components may be present in the printhead (116) and printer cartridge (114). In some examples, the printer cartridge (114) is removable from a printing system for example, as a disposable printer cartridge.

Figure 3:
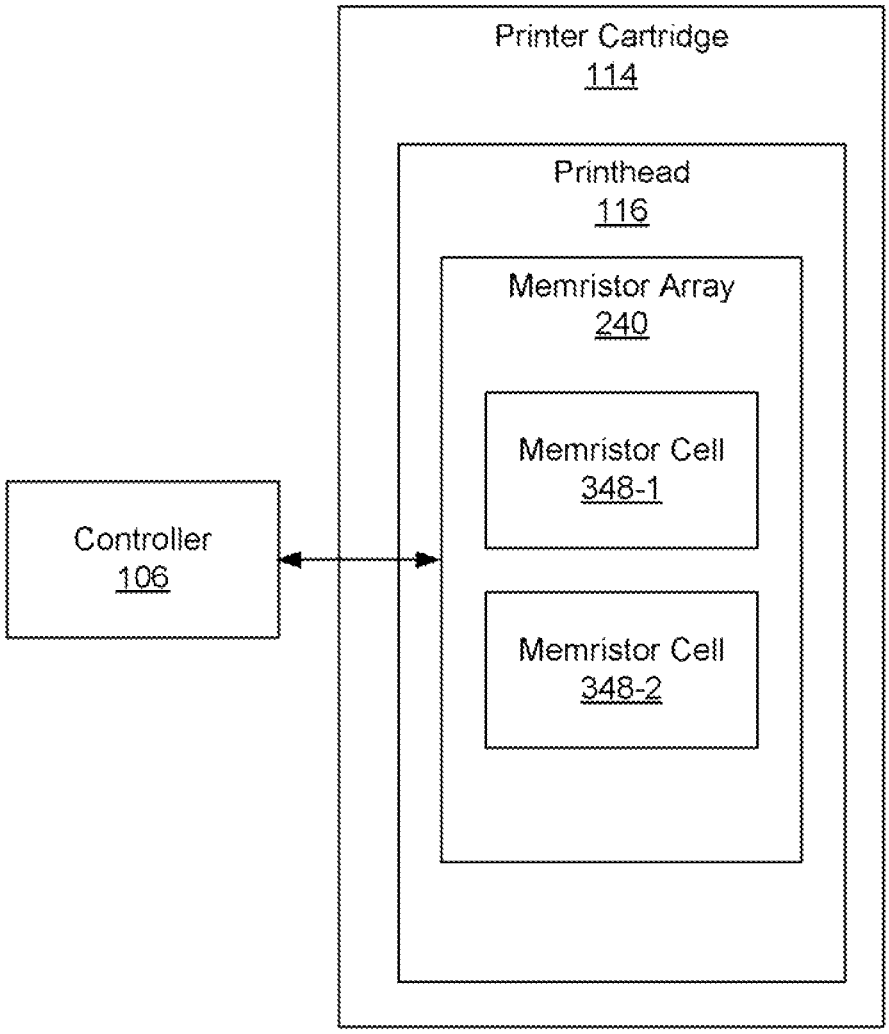
FIG. 3 is a block diagram of a printer cartridge that uses a printhead with a number of memristor cells and a parallel current distributor according to one example of the principles described herein.

FIG. 3 is a block diagram of a printer cartridge (114) that uses a printhead (116) with a number of memristor cells (348) and a parallel current distributor according to one example of the principles described herein. In some examples, the printer cartridge (114) includes a printhead (116) that carries out at least a part of the functionality of the printer cartridge (114). For example, the printhead (116) may include a number of nozzles (FIG. 1, 124). The printhead (116) ejects drops of fluid from the nozzles (FIG. 1, 124) onto a print medium (FIG. 1, 126) in accordance with a received print job. The printhead (116) may also include other circuitry to carry out various functions related to printing. In some examples, the printhead (116) is part of a larger system such as an integrated printhead (IPH) The printhead (116) may be of varying types. For example, the printhead (116) may be a thermal inkjet (TIM printhead or a piezoelectric inkjet (PIJ) printhead, among other types of printhead (116).

The printhead (116) includes a memristor array (240) to store information relating to at least one of the printer cartridge (114) and the printhead (116). In some examples, the memristor array (240) includes a number of memristor cells (348) formed in the printhead (116). To store information, a memristor within each memristor cell (348) may be set to a particular resistance state. As memristors are non-volatile, this resistance state is retained even when power is removed from the printhead (116).

A memristor has a metal-insulator-metal layered structure. More specifically, the memristor may include a bottom electrode (metal), a switching oxide (insulator), and a top electrode (metal). A memristor may be classified as an anion device which includes an oxide insulator. Examples of such oxide insulators include transition metal oxides, complex oxides, and large band gap dielectrics in addition to other non-oxide materials. In this example, an aluminum-copper-silicon alloy oxide or tantalum oxide may be an example of a switching oxide in an anion device. In an anionic device, the switching mechanism is the oxygen vacancies in the oxide that are positively charged. By comparison, in a cation device the electrodes (i.e., the bottom electrode, the top electrode, or combinations thereof) are formed from an electrochemically active metal such as copper or silver.

The number of memristor cells (348) are grouped together into a memristor array (240). In some examples, the memristor array (240) may be a cross bar array. In this example, each memristor may be formed at an intersection of a first set of elements and a second number of elements, the elements forming a grid of intersecting nodes, each node defining a memristor. In another example, the memristor array (240) may include a number of memristor cells (348) that form a one-to-one structure with a number of transistors. For example, an integrated circuit may include a number of addressing units. Each addressing unit may include a number of components that allow for multiplexing and logic operations. The memristor cell (348) may be designed to be individually addressed by a distinct addressing unit. In some examples, the addressing units may be transistors. In this example, the memristor cell (348) may share a one transistor-one memristor (1T1M) addressing structure with the addressing units of the integrated circuit.

The memristor array (240) may be used to store any type of data. Examples of data that may be stored in the memristor array (240) include fluid supply specific data and/or fluid identification data, fluid characterization data, fluid usage data, printhead (116) specific data, printhead (116) identification data, warranty data, printhead (116) characterization data, printhead (116) usage data, authentication data, security data, Anti-Counterfeiting data (ACF), ink drop weight, firing frequency, initial printing position, acceleration information, and gyro information, among other form of data. In a number of examples, the memristor array (240) is written at the time of manufacturing and/or during the operation of the printer cartridge (114).

In some examples, the printer cartridge (114) may be coupled to a controller (106) that is disposed within the printer (FIG. 1, 104). The controller (106) receives a control signal from an external computing device (FIG. 1, 102). The controller (106) may be an Application-Specific Integrated Circuit (ASIC) found on the printer (FIG. 1, 104). A computing device (FIG. 1, 102) may send a print job to the printer cartridge (114), the print job being made up of text, images, or combinations thereof to be printed. The controller (106) may facilitate storing information to the memristor array (240). Specifically, the controller (106) may pass at least one control signal to the number of memristor cells (348). For example, the controller (106) may be coupled to the printhead (116), via a control line such as an identification line. Via the identification line, the controller (106) may change the resistance state of a number of memristors in the memristor array (240) to effectively store information to a memristor array (240). For example, the controller (106) may send data such as authentication data, security data, and print job data, in addition to other types of data to the printhead (116) to be stored on the memristor array (240).

While specific reference is made to an identification line, the controller (106) may share a number of lines of communication with the printhead (116), such as data lines, clock lines, and fire lines. For simplicity, in FIG. 3 the different communication lines are indicated by a single arrow.

Figure 4:
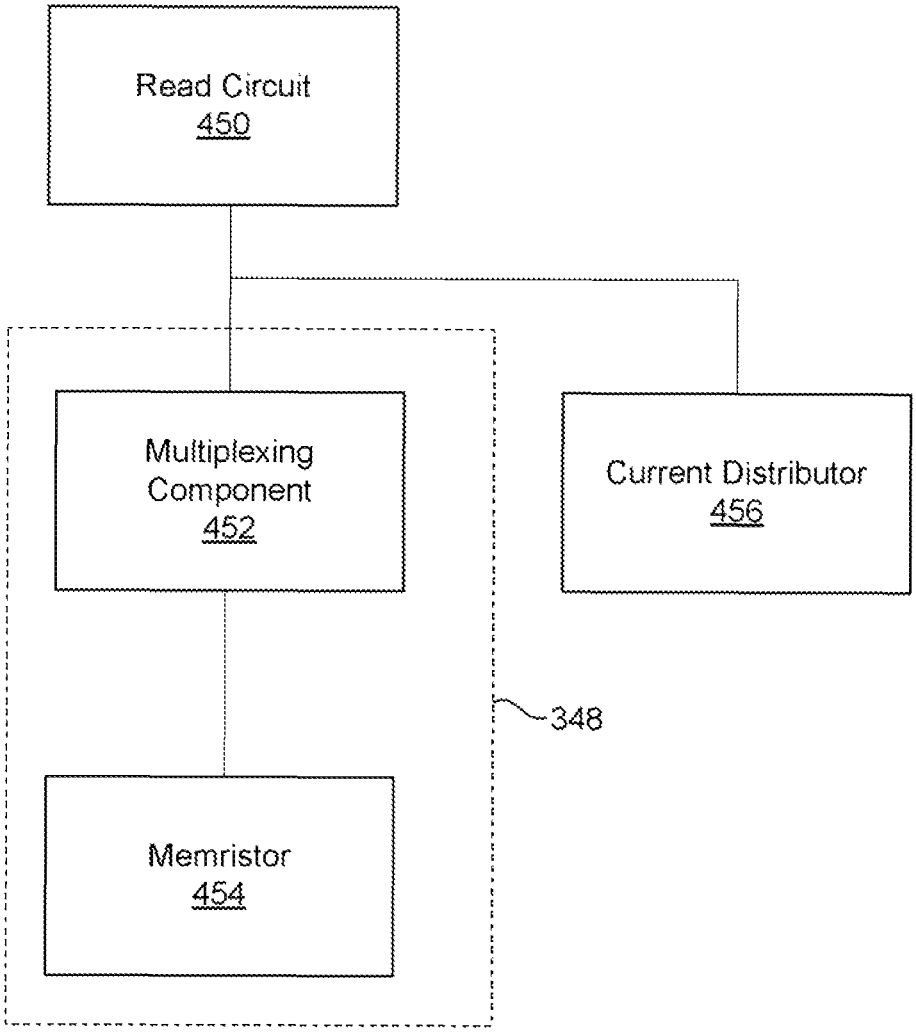
FIG. 4 is a block diagram of a memristor array and a parallel current distributor according to one example of the principles described herein.

FIG. 4 is a block diagram of a current distributor (456) and a memristor cell (348) according to one example of the principles described herein. While FIG. 4 depicts a single memristor cell (348) coupled to the current distributor (456) a number of memristor cells (348), such as memristor cells (348) in a memristor array (FIG. 2, 240) may be coupled to the current distributor (456). The memristor cell (348), indicated by a dashed box in FIG. 4, includes at least one memristor (454) to store information. As described above, a memristor (454) selectively stores data based on a resistance state of the memristor (454). For example, a memristor (454) may be in a low resistance state indicated by a "1," or a high resistance state indicated by a "0." A group of memristors (454), for example in an array (FIG. 2, 240) form a string of ones and zeroes that will store the aforementioned data.

The memristor cell (348) also includes a multiplexing component (452) that selects a particular memristor (454) to be read from, or to be written to. For example, as will be described in more detail in connection with FIG. 5, the multiplexing component (452) may include a number of transistors that select a memristor (454) in an array (FIG. 2, 240) such as a cross bar array. In other words, the multiplexing component (452) selects a memristor (454) to activate, an active memristor (454) being a memristor (454) that is to be written to or read from. Once active, the memristor (454) may be read from or written to.

As described above, information is read from a memristor (454) by passing a current through the memristor (454). A voltage across the memristor (454) is then measured and a resistance for the memristor (454) is calculated. Based on the resistance of the memristor (454), a controller (FIG. 1, 106) may ascertain a logical value associated with the memristor (454). This process is repeated for multiple memristors (454) such that a string of ones and zeroes is generated and data obtained. In this example, the read circuit (450) provides a current to the memristor cell (348). More specifically, the reading circuit (450) passes a current to the memristor (454) and a current distributor (456). In some examples, the controller (FIG. 1, 106) may pass a fixed current amount to the memristor cell (348). For example, the reading circuit (450) may pass a current of 1.2 mA to the memristor cell (348).

The current passed to the memristor cell (348) may cause the memristor (454) to inadvertently switch while data is being read from the memristor (454). Accordingly, the printhead (FIG. 1, 116) may include a current distributor (456) to reduce the current flow to the memristor (454) in the memristor cell (348). Specifically, the current distributor (456) may be connected in parallel to the memristor (454). As indicated in FIG. 4, the current distributor (456) may be positioned between the read circuit (450) and the multiplexing component (452) such that the current passing to the memristor (454) is a reduced amount of the current provided by the read circuit (450). For example, the read circuit (450) may supply a fixed 1.2 mA current source. The current distributor (456) may be positioned such that the current passed to the memristor (454) is an amount less than the 1.2 mA supplied by the read circuit (450). The current distributor (456) may be any number of circuit elements. A specific example is given below in connection with FIG. 5.

Including a current distributor (456) connected in parallel with the memristor (454) may be beneficial in that it reduces the current flowing through the memristor (454), thereby also reducing the voltage across the memristor (454). In some examples, the current distributor (456) and the resistances of the memristor (454) may be such that the voltage across the memristor (454) does not surpass the switching voltage of the memristor (454). As the voltage across the memristor (454) is not greater than the switching voltage, then the memristor (454) would not inadvertently switch during a reading operation. In other words, a current distributor (456) connected in parallel with the memristor (454) may lead to a retrieval of information that is less susceptible to incorrect reads or an entire failure to read.

Figure 5:
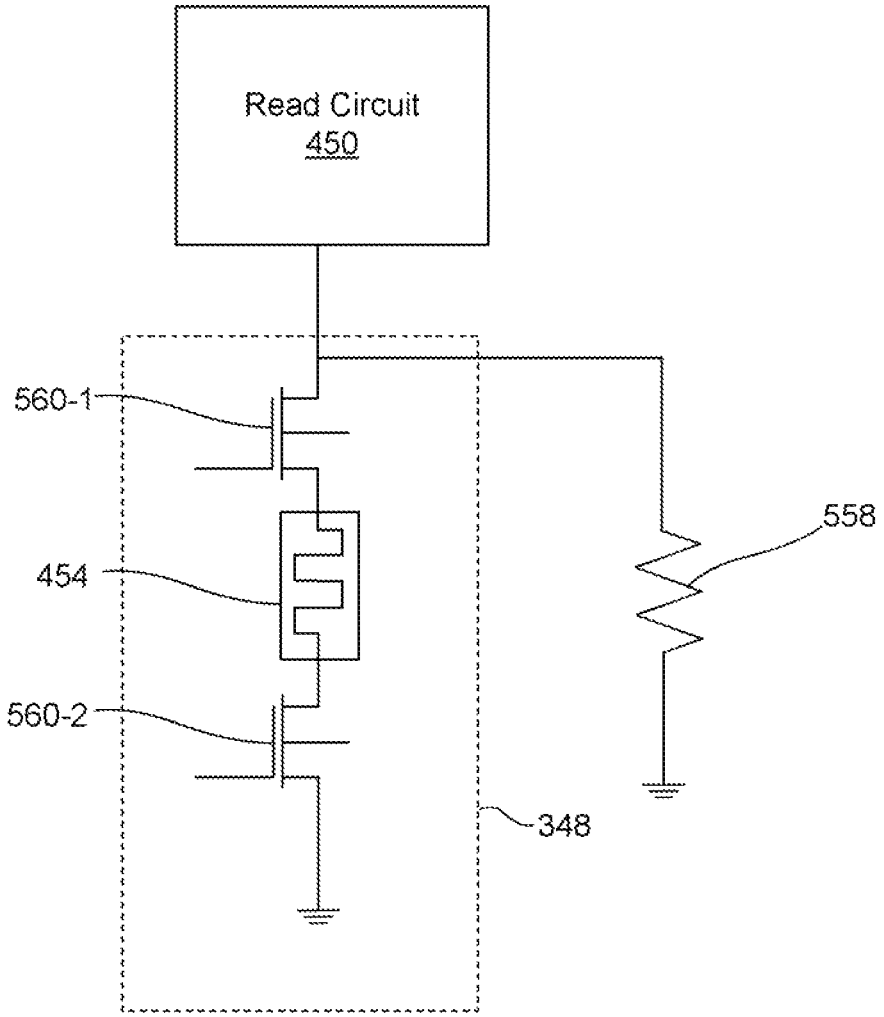
FIG. 5 is a circuit diagram of a memristor cell and a parallel current distributor according to one example of the principles described herein.

FIG. 5 is a circuit diagram of a memristor cell (348) and a parallel current distributor (FIG. 4, 456) according to one example of the principles described herein. As described above, a read circuit (450) may supply a current to a memristor cell (348) and a current distributor (FIG. 4, 456) may serve to reduce the current that passed to the memristor (454). In some examples, the current distributor (FIG. 4, 456) may be a resistor (558) that is connected in parallel with the memristor (454). The effect of the resistor (558) on the voltage passing through the memristor (454) can be mathematically analyzed using Kirchhoff's law and Ohm's law. A specific example is given as follows.

In this example, the memristor (454) may have a resistance of 6,000Ω, the read circuit (450) may provide a current of 1.2 mA and the resistor (558) may have a low resistance state of 1,000Ω and a high resistance state of 6,000Ω. First, in a high resistance state data may be read from the memristor (454) by passing the current through the memristor (454) and measuring the voltage across the memristor (454). In the absence of the resistor (558), the voltage across the memristor (454) may be calculated using Ohm's law, (V=R*I). In other words, the voltage equals 1.2 mA multiplied by 6,000Ω, resulting in a voltage of 7.2 V. As described above, this may lead to an inadvertent switch if the switching voltage for the memristor (454) is less than 7.2 V.

By comparison, the presence of the resistor (558) may reduce the current passing through the memristor (454). More specifically, continuing the example from above, based on Kirchhoff's law, the current passing through the memristor (454) may be reduced to 0.6 mA. Again, using Ohm's law, (V=R*I), the voltage across the memristor (454) may be determined to be 3.6 V (0.6 mA times 6,000Ω). Therefore, as described above, the resistor (558) may be beneficial by reducing the current and corresponding voltage, at the memristor (454) to avoid an inadvertent switch of the memristor (454) during a read operation. In other words, the parallel resistor (558) allows the memristor (454) to operate within a safe region below the switching voltage of the memristor (454).

In some examples, the resistance value of the resistor (558) may be any value that allows a program ratio of the memristor cell (348) to be a particular amount. A program ratio of the memristor cell (348) refers to a ratio of the resistance of the memristor (454) in a high resistance state to a resistance of the memristor (454) in a low resistance state. An example is given as follows. In this example, the resistance of the resistor (558) may be 6,000Ω and the high resistance state of the memristor (454) may be 6,000Ω and the low resistance state of the memristor (454) may be 1,000Ω. The total resistance of the memristor cell (348) when the memristor is in a high resistance state may be calculated using the following equation:

$$R_{tot} = 1 \Big/ \left( \frac{1}{R_{mem}} + \frac{1}{R_{res}} \right). \qquad \text{(Formula 1)}$$

In Formula 1, $R_{tot}$ refers to the total resistance of the memristor cell (348), $R_{mem}$ refers to the resistance of the memristor (454) in a high resistance state and $R_{res}$ refers to the resistance of the resistor (558). According to this equation, the resistance of the memristor cell (348), $R_{tot}$, when the memristor (454) is in a high resistance state is approximately 3,000Ω.

In a low resistance state, the memristor (454) may have a resistance of 1,000Ω. Again, using Formula 1 the total resistance of the memristor cell (348), $R_{tot}$, when the memristor (454) is in a low resistance state is approximately 857Ω. Thus a program ratio for the memristor cell (348) may be 3,000Ω divided by 857Ω or 3.5:1. While specific reference is made to specific values, any value resistor (558) and resistance states for the memristor (454) may be used such that the program ratio is a particular value. A program ratio of this particular value may allow for clear indication of a memristor (454) in a high resistance state and a memristor (454) in a low resistance state, which clear indication also allows for a clear indication of a logical value associated with the memristor (454).

As described above, in some examples, the memristor array (FIG. 2, 240) may be part of a cross bar array. In this example, the multiplexing component (FIG. 4, 452) may include a first transistor (560-1) placed serially before the memristor (454) and a second transistor (560-2) placed serially after the memristor (454). In a cross bar array a number of columns of traces and a number of rows of traces may be positioned to form a grid. Each intersection of the grid defines a memristor (454). A memristor (454) may be selected by actively selecting a row and a column. An active memristor (454) is a memristor (454) whose row and column are selected. In this example, a first transistor (560-1) may be used to indicate a row of the memristor (454) has been selected and a second transistor (560-2) may be used to indicate a column of the memristor (454) has been selected. Accordingly, a memristor (454) may be selected when both transistors (560-1, 560-2) are closed. While FIG. 5 depicts a memristor (454) with two transistors (560) as in a cross bar array, the memristor (454) may be used in a one-to-one relationship with a transistor such that a single transistor (560) may be used to select a particular memristor (454) While FIG. 5 depicts the memristor (454) being between transistors (560) other orientations may also be used. For example, the memristor (454) may be below two cascading transistors (560), or may be above two cascading transistors (560).

A transistor (560) is a device that regulates current and acts as a switch for electronic signals. For example, a transistor (560) may allow current to flow through the memristor (454), which flow changes a state of the memristor (454), i.e., from a low resistance state to a high resistance state or from a high resistance state to a low resistance state. As described above, this change of state allows a memristor (454) to store information. A transistor (560) may include a source, a gate, and a drain. Electrical current flows from the source to the drain based on an applied voltage at the gate. For example, when no voltage is applied at the gate, no current flows between the source and the drain. By comparison, when there is an applied voltage at the gate, current readily flows between the source and the drain.

Figure 6:
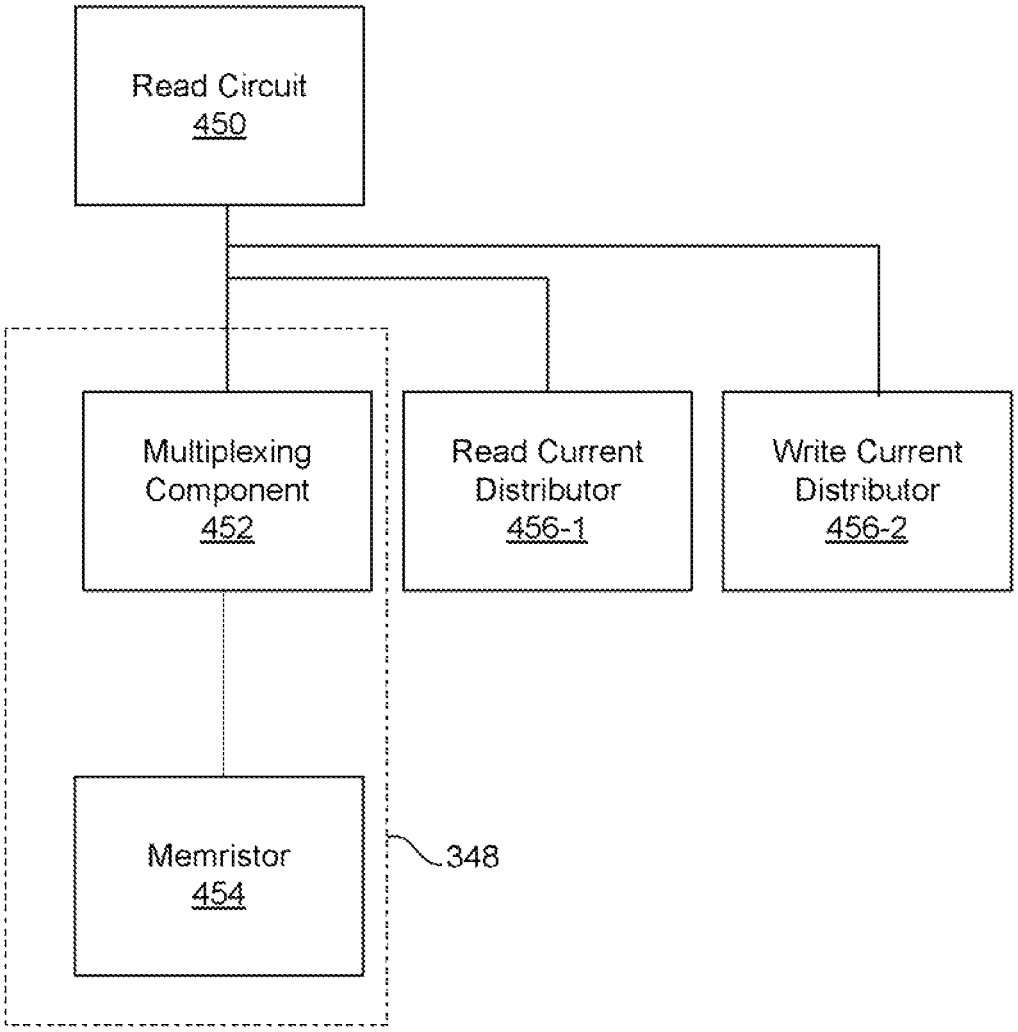
FIG. 6 is a block diagram of a memristor cell and multiple parallel current distributors according to one example of the principles described herein.

FIG. 6 is a block diagram of a memristor cell (348) and multiple parallel current distributors (456-1, 456-2) according to one example of the principles described herein. As indicated in FIG. 6, in this example, the memristor cell (348) may be coupled to multiple current distributors (456). Accordingly, the memristor cell (348) of the present disclosure may be coupled to any number of current distributors (456). In some examples, the memristor cell (348) may be coupled to separate read and write operation current distributors (456-1, 456-2) for adjusting the current that passes through the memristor (454). For example, a read current distributor (456-1), which may have lower resistance resistor may be used to direct more current through the memristor (454) when performing a read operation as compared to the write current distributor (456-2). Similarly, the write current distributor (456-2), which may have a higher resistance resistor may be used to direct less current through the memristor (454) when performing a write operation as compared to the read current distributor (456-1).

Including separated read and write current distributors (456-1, 456-2) may be beneficial by both reducing the risk of inadvertent switching during a read operation as well as increasing the writing efficiency during a write operation.

The memristor cell (348) may also include a multiplexing component. Including multiple current distributors (456) each connected in parallel to the memristor (454) may be beneficial in that a desirable program ratio may be achieved by switching between the read current distributor (456-1) and the write current distributor (456-2) while maintaining the memristor (454) resistance within a safe operating range, or a range in which an inadvertent switch of resistance states is avoided.

Figure 7:
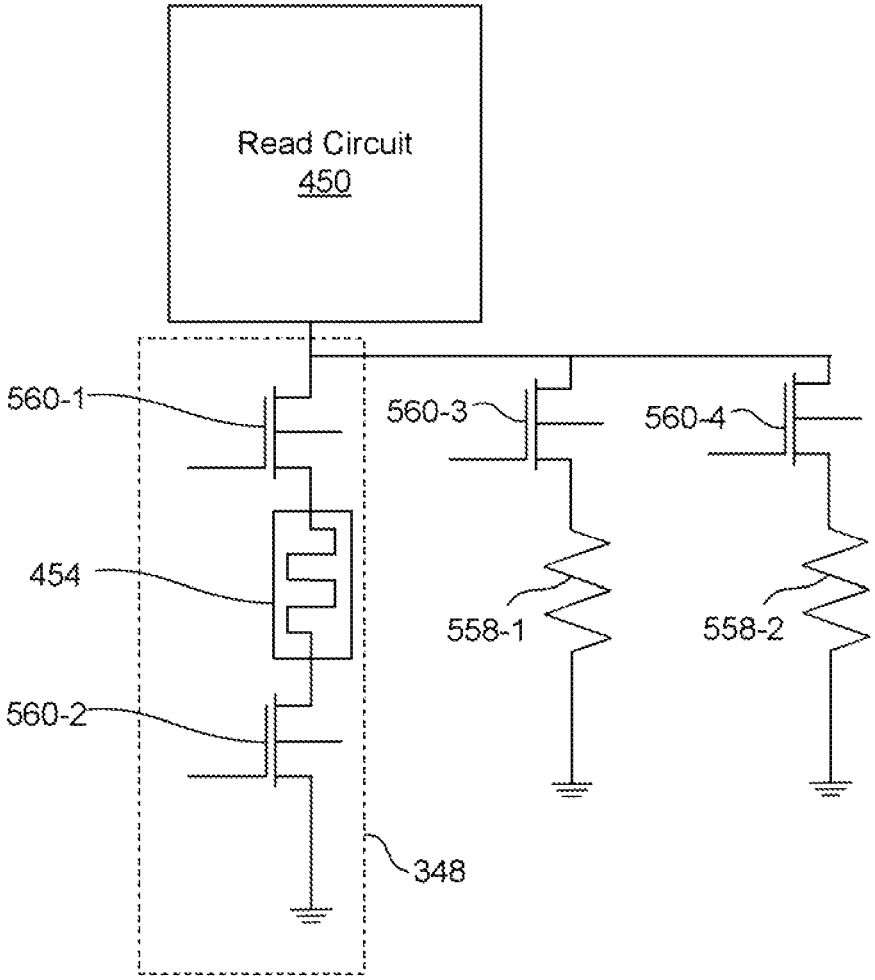
FIG. 7 is a circuit diagram of a memristor cell and multiple parallel current distributors according to one example of the principles described herein.

FIG. 7 is a circuit diagram of a memristor cell (348) and multiple parallel current distributors (FIG. 4, 456) according to one example of the principles described herein. As described above, a read circuit (450) may supply a current to a memristor cell (348) and a current distributor (FIG. 4, 456) may serve to reduce the current that passes to the memristor (454). More specifically, as described in connection with FIG. 6, a memristor cell (348) may be coupled to multiple current distributors (FIG. 4, 456) to further tailor the program ratio of the memristor cell (348). In this example, the each current distributor (FIG. 4, 456) may include an operation selecting transistor (560-3, 560-4) and a resistor (558-1, 558-2). More specifically, a read current distributor (FIG. 6, 456-1) may include a first selecting transistor (560-3) and a first resistor (558-1) and a write current distributor (FIG. 6, 456-2) may include a second selecting transistor (560-4) and a second resistor (558-2). The selecting transistors (560-3, 560-4) may serve to indicate which resistor (558), and corresponding resistance values should be used during particular operations. In some examples, the first resistor (558-1) may have less resistance than the second resistor (558-2). For example, the first resistor (558-1) may have a resistance value of 3,000Ω and the second resistor (558-2) may have a resistance value of 10,000Ω.

When performing a read operation, the second selecting transistor (560-4) may be open such that the second resistor (558-2) doesn't impact the flow of current to the memristor (454). Similarly, when performing a write operation, the first selecting transistor (560-3) may be open such that the first resistor (558-1) doesn't impact the flow of current to the memristor (454). As described above, having multiple current distributors (FIG. 6, 456), more specifically having resistors (558-1, 558-2) of different values that may be selectively used to manipulate the current passing through the memristor (454) may be beneficial in that a greater flexibility regarding the program ratio may be acquired.

A printer cartridge (FIG. 1, 114) and printhead (FIG. 1, 116) with a number of memristor cells (FIG. 3, 307) and a parallel current distributor (FIG. 4, 456) may have a number of advantages, including: (1) reducing the voltage across a memristor (FIG. 4, 454) such that the memristor (FIG. 4, 454) operates in a range where inadvertent switching is avoided; (2) operating at a voltage that is less than a controller (FIG. 1, 106) threshold value; (3) providing an additional electrostatic discharge path to further protect the memristor (FIG. 4, 454); (4) improving printhead (FIG. 1, 116) memory performance; and (5) reducing cost of effective memristor cell (FIG. 3, 348) fabrication.

Aspects of the present system are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (FIG. 1, 108) of the printer (FIG. 1, 104) or other programmable data processing apparatus. Implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead with a number of memristors and a parallel current distributor, the printhead comprising:

a number of nozzles to deposit an amount of fluid onto a print medium, each nozzle comprising:

a firing chamber to hold the amount of fluid;

an opening to dispense the amount of fluid onto the print medium; and an ejector to eject the amount of fluid through the opening;

a number of memristor cells, each memristor cell comprising:

a memristor to store information;

a multiplexing component to select a memristor, and at least one current distributor connected in parallel to a number of memristor cells.

2. The printhead of claim 1, in which the fluid is inkjet ink.

3. The printhead of claim 1, in which the printhead is coupled to a read circuit to read data from the memristor, write data to the memristor, or combinations thereof.

4. The printhead of claim 3, in which the current distributor is positioned between the read circuit and the memristor cell.

5. The printhead of claim 1, in which the current distributor comprises a single resistor.

6. The printhead of claim 1, in which the printhead comprises multiple current distributors, in which each current distributor is connected in parallel to a number of memristor cells.

7. The printhead of claim 6, in which:

a read current distributor comprises a first transistor and a first resistor; and a write current distributor comprises a second transistor and a second resistor.

8. A printer cartridge with a number of memristors and a parallel current distributor, the printer cartridge comprising:

a fluid supply; and a printhead to deposit fluid from the fluid supply onto a print medium, the printhead comprising:

at least one memristor;

at least one multiplexing component coupled to the memristor; and at least one current distributor connected in parallel to the memristor to reduce current flow through the memristor.

9. The cartridge of claim 8, in which:

the fluid is inkjet ink;

the printer cartridge is an inkjet printer cartridge; and the printhead is an inkjet printhead.

10. The cartridge of claim 8, in which the at least one memristor receives at least one control signal from a controller.

11. The cartridge of claim 8, in which the at least one memristor is part of a cross bar memristor array.

12. The cartridge of claim 8, in which the at least one memristor forms a one transistor-one memristor structure with a corresponding transistor.

13. The cartridge of claim 8, in which the current distributor comprises at least one resistor.

14. The cartridge of claim 8, in which the printhead comprises multiple selector components coupled to an instance of a memristor, in which:

a first selector is placed before the memristor in a serial connection; and a second selector is placed after the memristor in a serial connection.

15. The cartridge of claim 8, in which the at least one current distributor is connected in parallel to a number of memristors.

* * * * *